US009204718B2

(12) United States Patent
Magaudda

(10) Patent No.: US 9,204,718 B2
(45) Date of Patent: Dec. 8, 2015

(54) SLANT BOARD

(76) Inventor: Paul Steven Magaudda, La Jolla, CA (US)

( * ) Notice: Subject to any disclaimer, the term of this patent is extended or adjusted under 35 U.S.C. 154(b) by 322 days.

(21) Appl. No.: 12/657,001

(22) Filed: Jan. 11, 2010

(65) Prior Publication Data

US 2011/0168865 A1 Jul. 14, 2011

(51) Int. Cl.

| | |
|---|---|
| ***A47B 97/04*** | (2006.01) |
| ***A47B 23/04*** | (2006.01) |
| ***A47B 23/06*** | (2006.01) |

(52) U.S. Cl.

CPC ..... *A47B 23/044* (2013.01); *A47B 23/06* (2013.01)

(58) Field of Classification Search

USPC ..... 248/452, 441.1, 453, 455, 460, 463, 248/464, 465, 442.1, 446, 447, 449

See application file for complete search history.

(56) References Cited

U.S. PATENT DOCUMENTS

| | | | | | |
|---|---|---|---|---|---|
| 2,404,563 | A * | 7/1946 | Berliner | 434/410 |
| 3,692,273 | A * | 9/1972 | Woolman | 248/460 |
| 4,403,761 | A * | 9/1983 | Jamar | 248/447.1 |
| 4,667,919 | A * | 5/1987 | Teague | 248/450 |
| 5,367,350 | A * | 11/1994 | Winfrey | 353/120 |
| D399,368 | S * | 10/1998 | Herrera | D6/419 |
| 5,829,787 | A * | 11/1998 | Newhouse, Jr. | 281/46 |
| 5,950,815 | A * | 9/1999 | Yetman-Bellows | 206/6.1 |
| 6,007,891 | A * | 12/1999 | Davis et al. | 428/81 |
| 6,213,439 | B1 * | 4/2001 | Giulie et al. | 248/459 |
| 6,435,466 | B1 * | 8/2002 | Adams | 248/455 |
| 6,568,650 | B2 * | 5/2003 | Helmetsie et al. | 248/678 |
| 6,866,516 | B2 * | 3/2005 | Smith et al. | 434/408 |
| 7,017,878 | B2 * | 3/2006 | Guo et al. | 248/309.1 |
| 7,178,778 | B2 * | 2/2007 | Lee | 248/459 |
| 7,185,869 | B2 * | 3/2007 | Smith | 248/456 |
| 7,255,566 | B2 * | 8/2007 | Galbraith Coates | 434/408 |
| 7,417,853 | B1 * | 8/2008 | Myers et al. | 361/679.55 |
| 7,568,915 | B1 * | 8/2009 | Lavoie | 434/408 |
| 7,874,842 | B2 * | 1/2011 | Beno | 434/408 |
| 7,980,857 | B2 * | 7/2011 | Cheris et al. | 434/408 |
| 2002/0100398 | A1 * | 8/2002 | Santini | 108/157.1 |
| 2002/0189508 | A1 * | 12/2002 | Todd | 108/115 |
| 2004/0188588 | A1 * | 9/2004 | Smith | 248/459 |
| 2004/0251289 | A1 * | 12/2004 | Chretien et al. | 224/411 |
| 2005/0110309 | A1 * | 5/2005 | Cziraky et al. | 297/181 |
| 2005/0236347 | A1 * | 10/2005 | Cole et al. | 211/94.01 |
| 2008/0248456 | A1 * | 10/2008 | Cheris et al. | 434/415 |
| 2010/0031855 | A1 * | 2/2010 | Zhu | 108/4 |

* cited by examiner

*Primary Examiner* — Monica Millner

(74) *Attorney, Agent, or Firm* — Mark R. Huebscher; TechLaw LLP

(57) ABSTRACT

An adaptive aid used for reading, writing and with a laptop computer for typing. The Slant Board is comprised of several components that when assembled work in synergy to provide the unique functions of the invention. The folding locking legs are utilized to set the dry erase/magnetic-working surface at a prescribed angle to perform a task. The Slant Board is compact for storage, multifunctional in its uses and light-weight for transportability.

2 Claims, 3 Drawing Sheets

SLANT BOARD

BACKGROUND OF THE INVENTION

This invention relates to sloped surfaces as it applies to reading, writing material and typing with a computer keyboard or laptop computer to optimize the learning environment and work experience through the use of a properly angled work surface. As determined by the research of Dr. Darrel Boyd Harmon and subsequent studies by Drs. John Pierce and Steven Greenspan that have proven there is improved learning performance when the proper conditions are established. This invention allows those conditions to be met.

SUMMARY OF THE INVENTION

In general the Slant Board is placed on a desk, table or other horizontal surface to perform the desired task. Reading, writing material a keyboard or laptop computer is placed on the Slant Board to conduct the associated task. The Slant Boards unique angle of 22 degrees forces the body into the proper posture that induces an optimum learning environment. This optimum learning environment includes a more stable breathing pattern, lower heart rate and an overall reduction in stress. The full page of reading, writing material is placed in focus at the same time making tracking easier and reducing the stress on the eyes by not having to constantly refocus as the reader progresses down the page. Additionally due to this constant focus the printed characters do not alter their perspective (i.e. remain constant) as the reader, writer moves down the page thus eliminating one of the problems associated with the brains vision processing of these characters. The unique angle of the Slant Board also allows for better ergonomics in writing and typing. At this angle of 22 degrees the strain on the writers or typist wrists are relieved by now utilizing the whole forearm instead of just the wrist. This reduces fatigue and strain as well as providing more control. The Slant Board incorporates several other features, which are unique to this sloped work surface from others of similar utility in the market. These include incorporating a (1) slant board panel with a dry erase and magnetic work surface to accomplish direct on board tasks. A (2) spring loaded metal paper catch at the top of the slant board panel to hold your work firmly to the Slant Board. (3) A plastic book catch at the bottom center of the slant board panel to support a large book, sheet paper or up to a 17-inch laptop computer or keyboard. The Slant Board incorporates (4) mold injected plastic locking folding legs of unique utility that lock in the extended position for stability and to achieve the proper angle for the Slant Board. The legs then fold flat against the underside of the slant board panel to allow for compact storage. All items, except the plastic book catch, are attached to the slant board panel with (5) rivets. (6) Rubber bumpers are used to support the bottom of the slant board panel and prevent the Slant Board from slippage. The book catch is attached to the slant board panel with the use of (7) VELCRO to adhere it to the underside bottom center of the slant board panel. If desired the book catch can also be removed from the bottom center of the slant board panel for an obstruction free writing surface. The plastic book catch can then be stored at the top right of the Slant Board with another VELCRO strip located at the underside of the top right of the slant board panel. The Slant Board is to be used by Adults and Children. The Slant Board is prescribed by Vision Development Optometrists to patents for use in Vision Therapy treatment and utilized by Reading Specialist, Occupational Therapist and for general use by Students in the classroom environment.

DETAILED DESCRIPTION OF THE PREFERRED EMBODIMENTS

Figure 1:
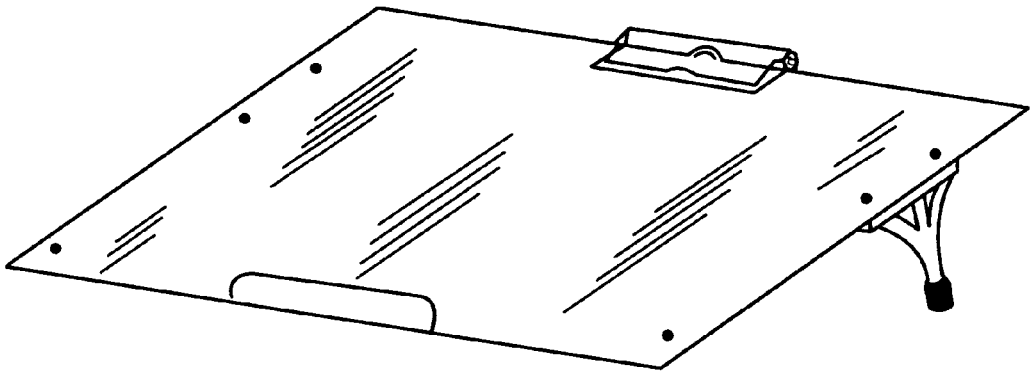
FIG. 1 is a perspective view of the Slant Board set up as it is to be utilized for reading, writing or typing.

In the description which follows like parts are marked throughout the specification and drawing with the same reference numerals, respectively. The drawing figures are to ¼ inch scale and certain features that may be exaggerated in scale in the interest of clarity and conciseness.

Referring to FIG. 1 the Slant Board is shown in the position of intended use. On any flat surface that would allow the user to either sit or stand in front of the Slant Board. The invention itself is comprised of several separate parts. (1) The slant board panel is a compressed epoxy/particle board material with a magnetic metal plate coated with a dry erases material glued to the surface of the epoxy/particle board. (2) A metal spring-loaded paper clip used at the top center of the slant board panel. (3) An "L" shape formed plastic peace used as the book catch at the bottom center of the slant board panel. (4) Injection molded plastic legs located on the right and left underside of the slant board panel. These legs are of unique utility designed to lock in the extended position for stability and then fold to lay flat against the underside of the slant board panel for compact storage. (5) Aluminum rivets are used to secure the following parts to the slant board panel: (2) metal spring loaded paper catch, (4) injection mold plastic legs, (6) rubber bumpers.

Figure 2:
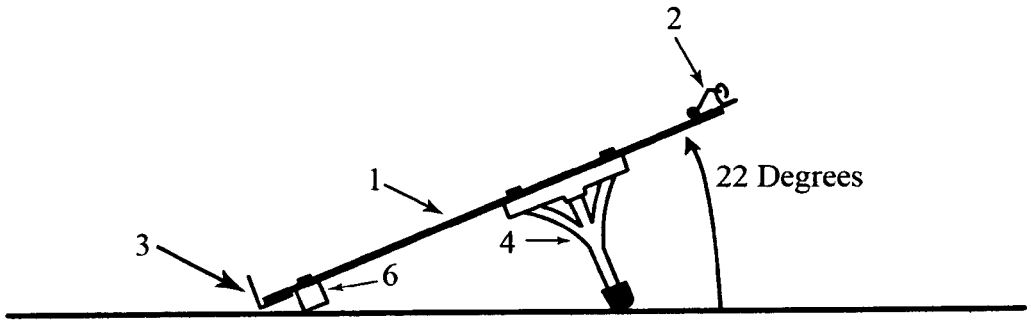
FIG. 2 is a side view of the Slant Board in FIG. 1 showing the board resting on a flat surface such as a table.
Figure 3:
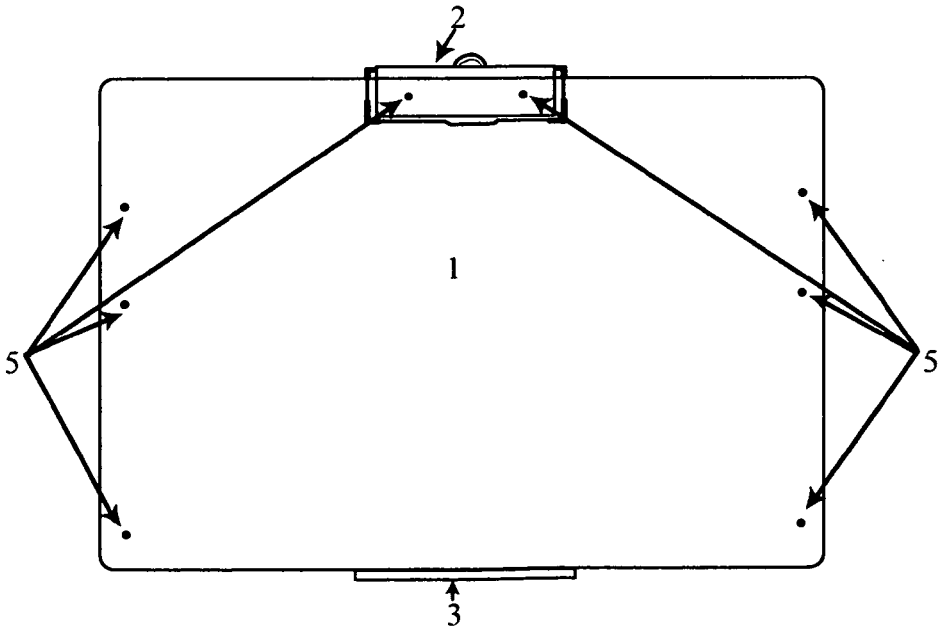
FIG. 3 is an overhead view of the Slant Board in FIG. 1.

Referring to FIG. 2 depicts a side view of the Slant Board. To the left hand side of FIG. 2 is the bottom of the Slant Board and conversely the right hand side of FIG. 2 is the top of the Slant Board. The Slant Boards main body is comprised of a compressed epoxy/particle board with a magnetic metal plate coated with a dry erase material on one side. This metal plate is glued to the compressed epoxy/particle board to form the (1) slant board panel. At the top of the slant board panel is a (2) metal spring-loaded paper clip. At the bottom of the slant board panel is the (3) "L" shaped formed plastic book catch. It is shown in its attached position, adhered to the underside of the slant board panel. (6) Rubber bumpers attached at the bottom of the slant board panel to help support the slant board panel and to prevent slippage. The (4) injection molded plastic legs are shown in the extended (locked) position. The legs are positioned so as to achieve the 22-degree angle, which is crucial for the utility of the Slant Board Referring to FIG. 3 depicts the overhead view of the Slant Board. The Slant Boards main body is comprised of a compressed epoxy/particle board with a magnetic metal plate coated with a dry erase material on one side. This metal plate is glued to the compressed epoxy/particle board to form the (1) slant board panel. At the top center of the slant board panel is a (2) metal spring-loaded paper clip. At the bottom center of the slant board panel is the (3) "L" shaped formed plastic book catch. It is shown in its attached position. Adhered to the underside of the slant board panel. (5) Rivets attach all items to the slant board panel except the plastic book catch. The relative locations of the rivets are shown as depicted.

Figure 4:
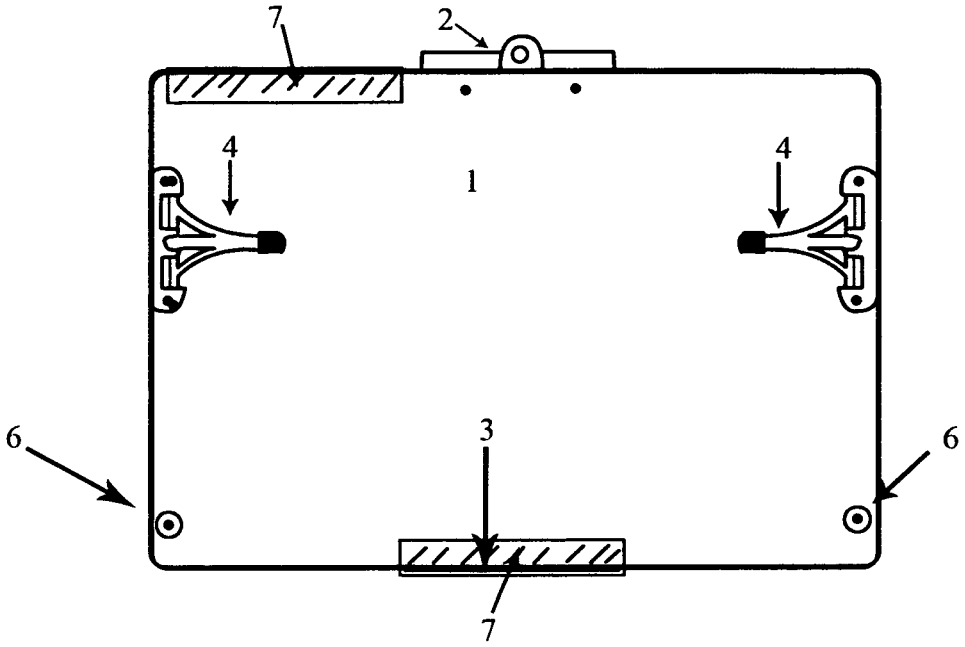
FIG. 4 is underside view of the Slant Board in FIG. 1.

Referring to FIG. 4 depicts the underside view of the Slant Board. The underside of the (1) slant board panel is lacquer coated. At the top center of the slant board panel is a (2) metal spring-loaded paper clip attached to the opposite side of the slant board panel. At the bottom center of the slant board panel is the (3) "L" shaped formed plastic book catch. It is shown in its attached position to the underside of the slant board panel as shown. The (4) injection molded plastic legs are shown laying flat against the underside of the slant board panel (folded position) for compact storage. The (6) rubber bumpers are positioned at the bottom corners of the slant board panel for support and to prevent slippage. (7) VELCRO strips are glued to the bottom center and the upper left of the underside of the slant board panel. VELCRO is also glued to one edge of the (3) plastic book catch. This allows the plastic book catch to be used to hold a book, sheet paper, laptop computer or keyboard. When removed it provides for an obstruction free writing surface. The plastic book catch can be stored at the top left (from the underside) of the slant board panel by the VELCRO strip located there.

The invention claimed is:

1. A portable work desk board consisting of:

a magnetic dry erase board defined by a top edge, a bottom edge, a left edge, and a right edge circumscribing a center portion, the center portion having a top side and an underside;

an L-shaped book catch disposed approximately at center bottom of the board, attached with a temporary hook and loop fastener fabric to the underside bottom edge center;

a metal spring-loaded clip attached with a temporary hook and loop fastener fabric to the underside bottom edge center;

two rubber bumpers, attached with rivets to the underside of the board adjacent a first corner and second corner, where the first corner is defined by the left edge and the bottom edge and the second corner is defined by the right edge and the bottom edge;

right and left foldable legs attached with rivets to the underside, wherein the right leg is attached above a mid-line along the right edge and the left leg is attached above mid-line along the left edge, wherein each leg has a folded position and an open position, the folded position being lain laterally (left-right) flat to the underside, the open position being extended away laterally from the underside and substantially perpendicular thereto, wherein the folded position is achieved by rotating laterally the open legs toward the center portion, whereby movement of the board in a vertical direction cannot cause a change in a folded position of the legs; and whereby the board achieves a fixed inclination angle between 20 and 23 degrees relative to a flat, horizontal surface when both legs are in the open position, causing the work desk to be tilted to a user at a fixed optimal learning angle of approximately 20-23 degrees.

2. The work desk board of claim 1, further comprising a hook and loop fastener fabric attached to a portion of an underside, top edge of the board.

* * * * *